United States Patent [19]

Knaack

[11] Patent Number: 4,823,764

[45] Date of Patent: Apr. 25, 1989

[54] BOW MOUNTED QUIVER

[76] Inventor: Randy L. Knaack, 1419 Tainter St., Menomonie, Wis. 54751

[21] Appl. No.: 74,068

[22] Filed: Jul. 16, 1987

[51] Int. Cl.[4] ..... F41B 5/06

[52] U.S. Cl. ..... 124/88; 124/23 A; 124/41 R; 124/45; 224/916

[58] Field of Search ..... 124/23 R, 23 A, 24 R, 124/24 A, 41, 45, 86, 88; 224/916; 16/225, 385, DIG. 13; 24/17 B, 300, 301, 336; 211/60.1

[56] References Cited

U.S. PATENT DOCUMENTS

| | | | |
|---|---|---|---|
| 2,464,068 | 3/1949 | Bear | 224/916 X |
| 2,909,167 | 10/1959 | Fredrickson | 124/24 |
| 2,999,620 | 9/1961 | Haggard | 124/41 R |
| 3,017,874 | 1/1962 | Gubash | 124/23 |
| 3,209,740 | 10/1965 | Hauch | 124/24 A |
| 3,366,101 | 1/1968 | Saunders . | |
| 3,406,675 | 10/1968 | Fredrickson | 124/24 |
| 3,490,662 | 1/1970 | Ramsey | 124/41 R |
| 3,591,062 | 7/1971 | Karbo | 124/41 R |
| 3,595,214 | 7/1971 | O'Malley et al. | 124/24 |
| 3,595,215 | 7/1971 | Wilkie | 124/52 |
| 3,601,113 | 8/1971 | Wilkie | 124/48 |
| 4,020,984 | 5/1977 | Morris | 124/24 A X |
| 4,247,027 | 1/1981 | Tardiff | 124/24 A X |
| 4,363,312 | 12/1982 | Spitzke | 124/45 |
| 4,522,187 | 6/1985 | Tafel | 124/24 A |

*Primary Examiner*—Dennis L. Taylor
*Assistant Examiner*—John A. Ricci
*Attorney, Agent, or Firm*—Burd, Bartz & Gutenkauf

[57] ABSTRACT

A bow mounted quiver to hold a reserve supply of arrows in an alert status with respect to a bow for convenient and quick accessibility by an archer. An arrow rack is pivotally connected to a base that is assembled to the bow. The rack holds the arrows in parallel, vertically aligned relationship when the rack is in the alert position relative to the bow. The arrows are releasably held by arrow clip members. Drawing a stored arrow rearward releases it from the clip members. Upon release from the clip members the arrow is guided by the arrow shaft to the proper position.

15 Claims, 2 Drawing Sheets

FIG. 3
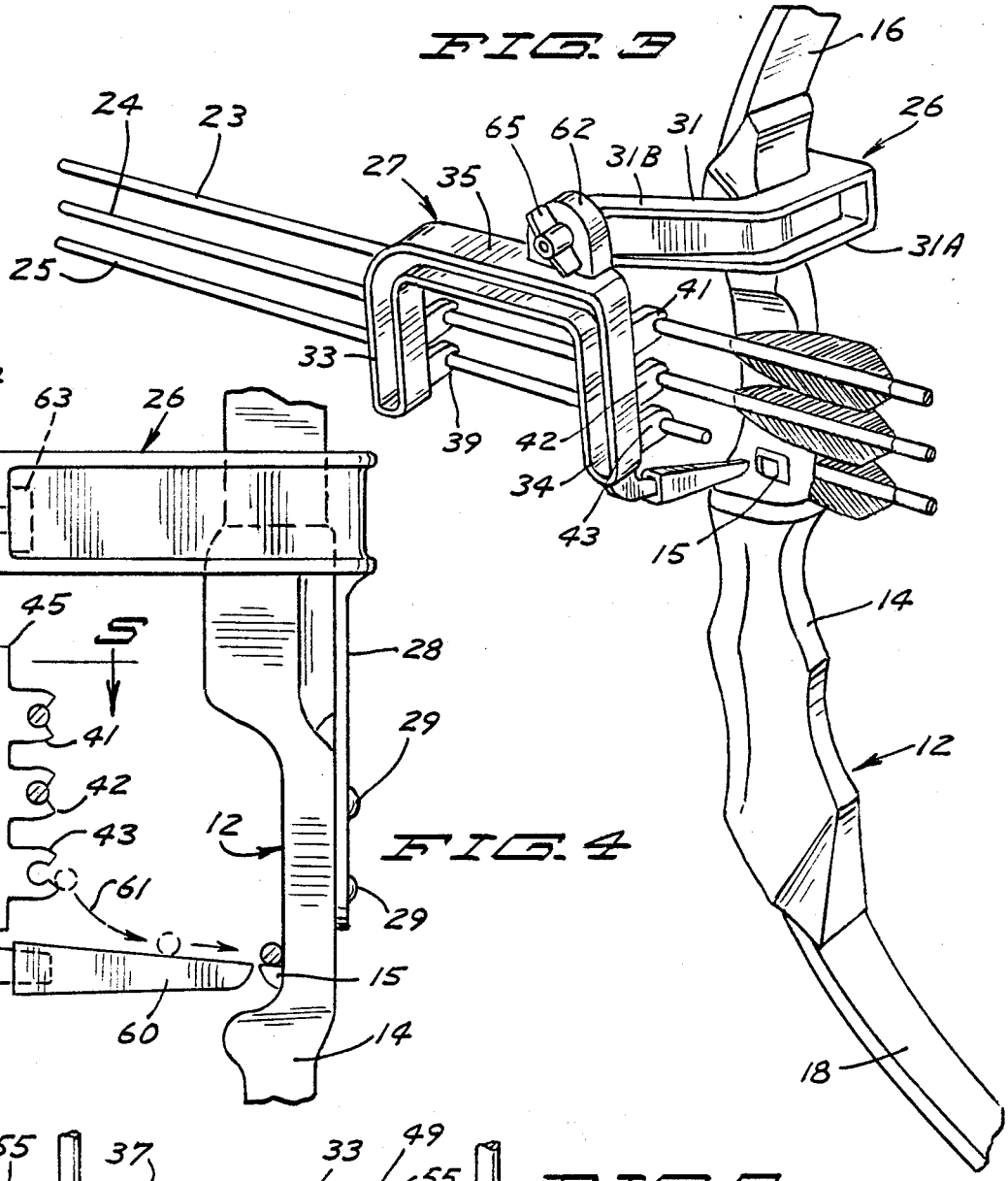
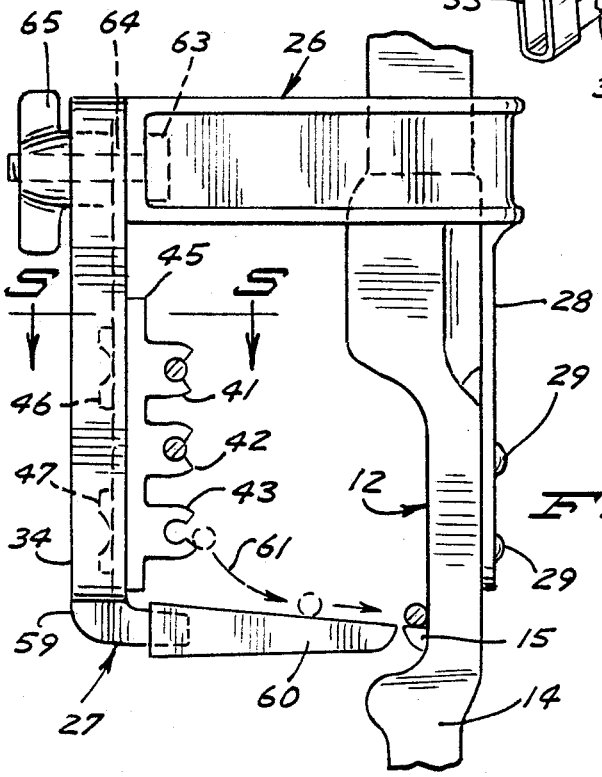
FIG. 4
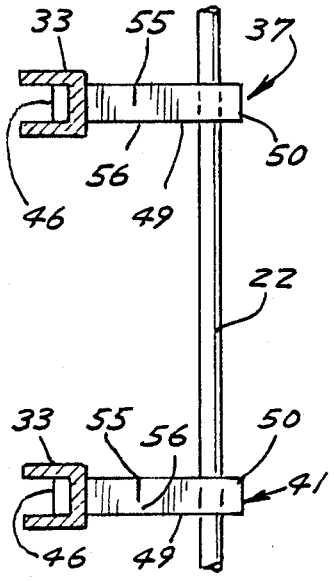
FIG. 5
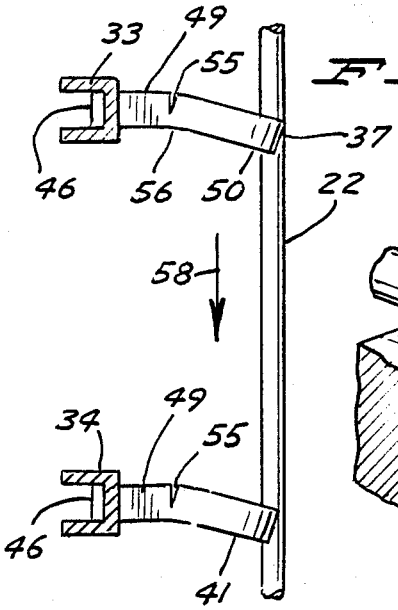
FIG. 6
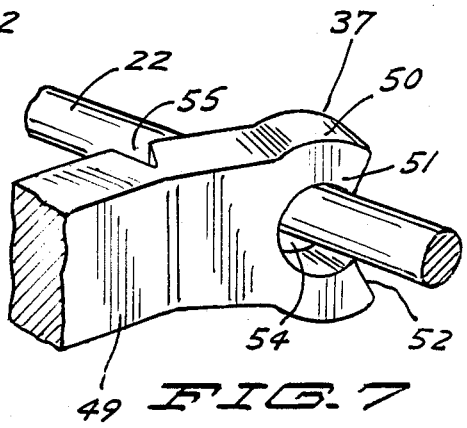
FIG. 7

BOW MOUNTED QUIVER

BACKGROUND OF THE INVENTION

In archery, the grestest impediment to rapid shooting is the accessibility of successive arrows which are conventionally carried in a case-type quiver slung over the shoulder of the archer or resting at the side of the archer. Reaching for the next arrow not only takes time but may cause momentary distraction to the archer, deflecting his attention from the target which might be a swiftly moving animal. Bow mounted quivers have been proposed to improve successive arrow accessibility and minimize the attendant distraction to the archer. Some such devices hold arrows in a compact storage orientation vertically arranged along side the bow. Others hold reserve arrows in a horizontal arrangement for even better accessibility to the archer. Some such devices are accompanied by visual blockage. Others are cumbersome when walking through the woods.

SUMMARY OF THE INVENTION

The invention pertains to a box mounted quiver to hold a reserve supply of arrows in alert status with respect to a bow for convenient and quick accessibility by the archer. The quiver includes a base fixed to the bow and a rack attached to the base. The rack has a plurality of arrow holders, each including a pair of spaced apart clips with grap the arrow shaft at longitudinally spaced apart positions. Each clip is formed of a resilient material and has a mouth and a throat open to the mouth. The arrow shaft is releasably held in the mouth of the clip and removable upon rearward longitudinal force exerted on the arrow shaft as by drawing it rearwardly by the archer preparatory to mounting it on the bow. In a preferred embodiment, the rack is rotatable with respect to the base in order to orientate the arrows in a vertical position along side the bow for transport of the bow and arrows with minimal obstruction.

IN THE DRAWINGS

FIG. 3 is an enlarged view of the handle section of the bow and bow mounted quiver of FIG. 2 viewed from a slightly elevated position;

FIG. 4 is an enlarged rear elevational view of the bow mounted quiver of the invention as mounted relative to the hand grip portion of the handle section of the bow;

FIG. 5 is an enlarged view partly in section of an arrow holder of the bow mounted quiver of FIG. 4 taken along the line 5—5 thereof;

FIG. 6 is an enlarged sectional view like that of FIG. 5 but showing the arrow shaft being drawn rearwardly for release from the arrow holder; and FIG. 7 is an enlarged view of one of the clip members of FIG. 6 shown in perpsective and in the process of release of an arrow.

DESCRIPTION OF A PREFERRED EMBODIMENT

Figure 1:
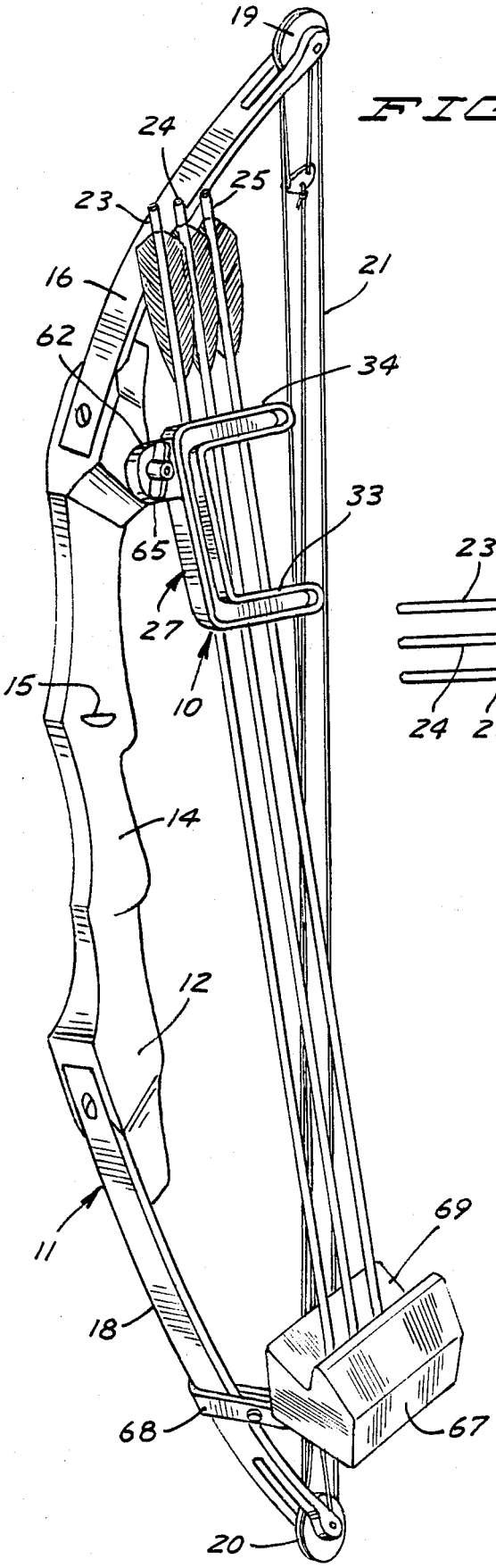
FIG. 1 is a perspective view of a bow equipped with a bow mounted quiver according to the invention with the arrows positioned in a retracted or stored position, viewed from a location ahead of the bow.
Figure 2:
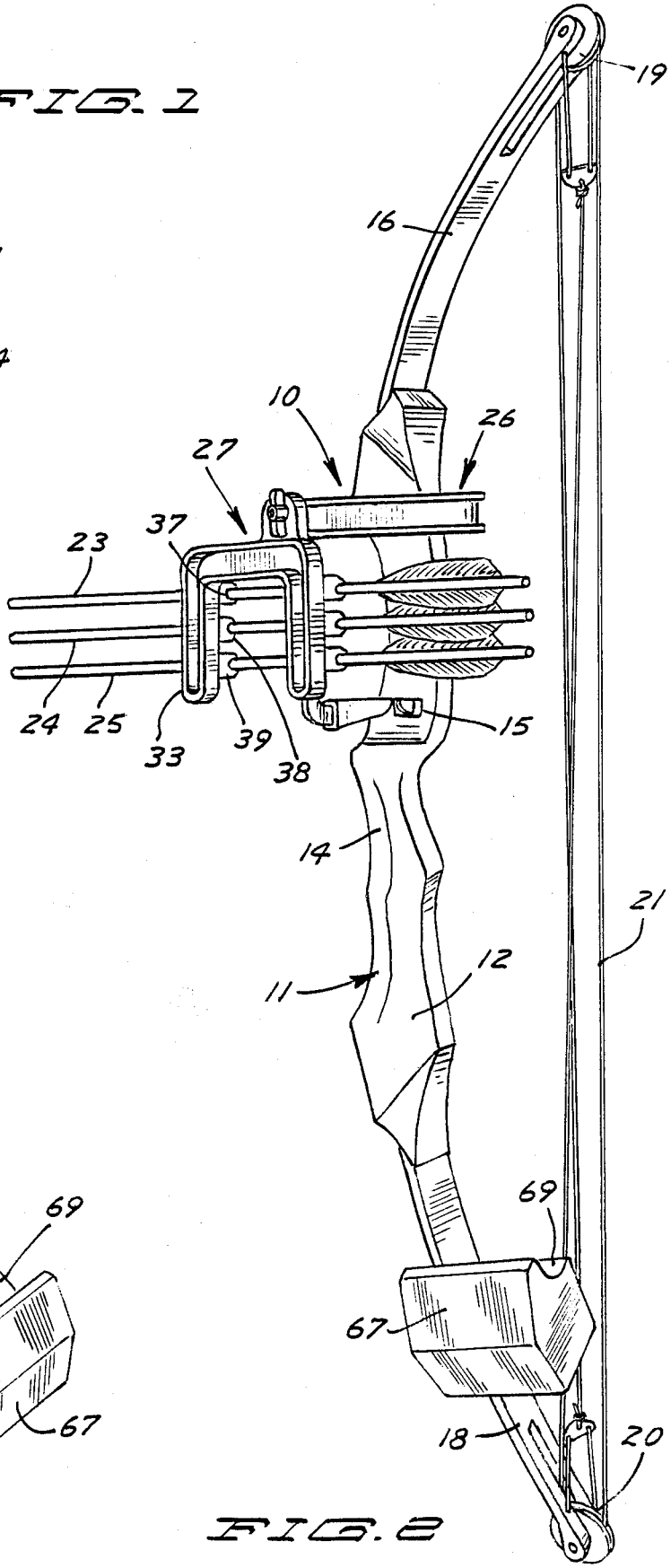
FIG. 2 is a perspective view of the bow and bow mounted quiver of FIG. 1 viewed from a position behind the bow and showing the quiver with the arrows in an alert, horizontally oriented position.

Referring to the drawings, there is shown in FIGS. 1 and 2 a bow mounted quiver according to the invention indicated generally at 10 mounted on a compound bow 11. Quiver 10 is usable on any conventional type bow as well. Quiver 10 is shown in the retracted position in FIG. 1 and in the alert or ready position in FIG. 2. Bow 11 has a middle or handle section 12 with a central hand grip 14 located just beneath an arrow rest 15 provided for supporting the arrow during sighting and shooting the arrow. An upper limb 16 is fixed at the upper portion of the handle section 12, and a lower limb 18 is fastened to the lower end of handle section 12. An eccentric pulley 19 is journaled in a clevis end the top of the upper limb 16, and another such pulley 20 is mounted at the end of the lower limb 18. A bow string 21 is trained between the ends of the upper and lower limbs 16, 18 and over the eccentric pulleys 19, 20 in usual and conventional fashion. The bow monted quiver 10 is armed with a plurality of arrows 23, 24, 25 which are in a vertical and stored orientation parallel to bow 11 in FIG. 1 and in a horizontal orientation in FIG. 2 perpendicular to bow 11 ready to be released from quiver 10 and mounted on arrow rest 15 for shooting. In the state of perparedness of FIG. 2, the arrows are quickly removed from quiver 10 and positioned on the arrow holder 15 with the arrow nock poised for engagement with bow string 21.

Quiver 10 includes a base 26 secured to the bow 11 and an arrow rack 27 pivotally connected to the base 26. Base 26 has a vertical bracket 28 that lies flat against a portion of the handle section 12 of bow 11 on the side opposite the arrow rest, in th region above handgrip 14. Mounted screws 29 pass through a vertical slot provided in bracket 28 that permits some vertical adjustment of base 26. Screws 29 are received in mounting holes conventionally provided in the handle section of archery bows for mounting various pieces of auxiliary equipment.

Base 26 includes a support beam 31 with a sction 31A extending from the upper end of the bracket 28, around the back of the bow 11 to the opposite side thereof, and a second section 31B which extends forward and outward from the arrow discharge side of bow 11.

Arrow rack 27 is comprised as a C-shaped member or frame which is downwardly facing in the alert position of FIGS. 2 and 3 with downwardly extended fore and aft legs 33, 34, upwardly connected by an arm 35. The parallel legs 33, 34 carry a plurality of releasable arrow holders to hold the arrows 23–25 in reserve readiness near the discharge location of the bow 11. Each arrow holder is comprised of a pair of spaced apart arrow shaft engaging clips which releasably engage the arrow shaft at longitudinally spaced apart locations thereon in a position to be readily grasped by the archer for release and proper positioning preparatory to shooting. The fore leg 33 of arrow rack 27 carries fore clips 37, 38, 39, and the rear leg 34 carries the aft clips 41, 42, 43 of three arrow holders (see FIG. 3). A first arrow holder is comprised of an uppermost fore clip 37 and an aligned uppermost aft clip 41 which engage an uppermost arrow 22 at spaced apart longitudinal positions along the shaft thereof. The second and third arrows 23, 34 are carried by second and third arrow holders comprised of the aligned second fore and aft clips 38, 42 and third fore and aft clips 39, 43.

As shown in FIG. 4, the aft set of clips 41–43 can have a common base 45 for easy installation and replacement when worn on aft leg 34 of arm rack 27. Clips 41–43 are formed of a resilient rubber or such material integrally formed with the flat base 45. On the side of base 45 opposite the clips is a pair of mounts each havng a pair of spreadable fingers 46, 47 passing through suitable openings formed in the side wall of the leg 34. In installation of base 45, the spreadable fingers 46, 47 are squeezed together and inserted through the opening in the side wall 34. Once through the opening, they expand as shown to hold the base securely in place. They are simply squeezed together for removal through the mounting holes as well.

FIGS. 5 and 6 illustrate the uppermost arrow holder having arrow holding clips 37, 41. The fore clips 37 is mounted on the fore leg 33, and aft clip 41 on the aft leg 46 of arrow rack 27. Each clip is comprised as a resilient member having a stem 49 and a head 50. The stem 49 extends outwardly from the base 45 of the set of clips and is uniform in depth and width. The head 50 is laterally enlarged relative to that of stem 49. The head is relatively C-shaped with lips 51, 52 defining a narrow throat open to an enlarged shaft holding mouth or opening 54 (see FIG. 7). Lips 51, 52 are resilient and part against pressure as when an arrow shaft is inserted through the throat into the opening 54. The arrow shaft 22 causes a slight enlargement of the space between the lips 51, 52 and a slight enlargement of the opening 54 to be retained frictionally therein. The stem 49 of each of the arrow clips has a forward facing slit 55 which extends the breadth of the stem and leaves an intact residual portion 56 which serves as a hinge for rotation of the head 50 relative to the lower portion of the stem 49.

In the use of an arrow holder, as shown in FIG. 5, the arrow shaft is at rest and engaged in the heads 50 of the fore and aft arrow holding clips 37, 41. The arrows is frictionally retained in the arrow holding clips and is not prone to be jarred or pushed loose. When the archer desires the next arrow from the rack 27 he grasps the fetch end thereof and pulls rearwardly in the direction indicated by the direction arrow 58 in FIG. 6. This produces a frictional drag in the opening 54 of the heads 50 which results in a pivoting of the heads 59 rearwardly with respect to the necks 49. As shown in FIGS. 6 and 7, the edge 51, 52 defining the throat to the opening 54 are canted with respect to the longitudinal axis of the arrow shaft 22 by virtue of the pivoting of the head 50. Gradually, the arrow shaft 22 moves through the canted edges or lips 51, 52 of the heads 50 and is released. The motion is accomplished simply by rearward movement of the arrow 22 without the archer having two exercise any significant amount of lateral force to release he arrow. One the arrow is released, the heads 50 snap back into place with respect to the necks 49 closing the slit 55.

Aft leg 37 of rack 27 carries an arrow shaft guide for movement of an arrow shaft released from a holder to the proper position with respect to the arrow rest 15 of bow 11. As shown in FIG. 4, a guide holder 59 is connected to the lower end of the aft leg 34 of arrow rack 27 and carries a resilient, elongate arrow guide member 60 which extends from the lower end of the aft leg 34 to a location proximate the arrow rest 15 in bow 11. Upon release an arrow from a holder, the shaft drops by gravity to the member guide 60 with the fetch end of the arrow held by the archer. The shaft is then guided as indicated by directional arrow 61 in FIG. 4, to proper placement on the arrow rest 15 whereupon the nock is engaged with the box string preparatory to shooting the arrow in usual fashion.

Arrow rack 27 is readily movable between the alert position of FIG. 2 and the travel or storage position of FIG. 1. A shoulder 62 is fixed to the connecting arm 35 of arm rack 27 near the aft end thereof and abuts the outer end of the outwardly extended section 31B of mounting arm 31. A threaded nut 63 is fixed to the side of mounting arm 31 opposite shoulder 62. A threaded shank 64 is fixed to a finger knob 65 located on the opposite side of the shoulder 62 and passes through suitably provided openings in the shoulder 62 and the end of the support arm 31 for engagement with the nut 63. Shank 64 is threadable into the nut 63 such that turning the finger knob 65 in a direction to advance the shank 64 into the nut 63 tightens the shoulder 62 against the end of support arm 31 to fix the arrow holder rack 27 in place with respect to the arm 31. Loosening of the finger knob 65 loosens the fit between the shoulder 62 and the end of the support arm 31 permitting rotation of the rack 27. If desired, meshing teeth (not shown) could be provided between abutting surfaces of the shoulder 62 and the end of arm 31 to more securely position them together when the knob 65 is tightened.

Arrow rack 27 is movable between the alert position of FIG. 2 and the travel or storage position of FIG. 1. A guard 67 is mounted by a bracket 68 to the lower end of the lower limb 18 of bow 11. Guard 67 is comprised as a block having a V-shaped opening 69 facing upward and positioned to intercept the tips of the arrows 23–25 as they are rotated downwardly with the arrow rack 27. When positioned in the V-shaped opening 69 of guard 67, the arrow tips are not prone to engage grass, weeds, clothing or other such items as the archer travels over the terrain with the bow 11 and arrows 23–25 mounted in rack 27.

In the use of the bow mounted quiver of the invention, the archer loads the quiver by snapping the arrows 23–25 into place. This is easily accomplished by positioning the shank of the arrow in the mouths of a pair of arrow clips forming an arrow holder and formed by the bevelled edges 51, 52 of the clip. Inward pressure on the shank toward the openings 54 snaps the arrow shank into place. The arrows are held in place until needed. The archer traverses the terrain with the arrow rack in the retracted position shown in FIG. 1 and the arrow tips located in the guard 67. Preparatory to shooting, the archer loosens the finger knob 65 to rotate the arrow rack to a position shown in FIG. 2 with the arrows in a horizontal orientation. The finger knob 65 is heightened to hold the arrow rack 27 in place. When the archer is ready to shoot, he loads the arrow by grasping the fetch end and pulling backwards. This releases the arrow from the arrow clips as previously described and shown in FIG. 6. The arrow shank drops down to the guide member 60 and is moved onto the arrow rest 15 whereupon the archer engages the bowstring with the arrow knock and draws the arrow back in usual fashion preparatory to shooting it. After shooting one arrow, the remaining arrows are ready at hand for the archer to grasp and load with minimal distraction. The quiver provides minimal visual impediment to the archer and adds minimal weight to the bow. It is adjustable up and down upon the bow by loosening of the screws 29 of the mount 28 and adjusting the vertical position of the mounting arm 31.

While there has been shown and described a preferred embodiment of an arrow quiver according to the invention, it will be apparent to those skilled in the art that certain deviations can be had from the embodiment shown without departing from the scope and spirit of the invention.

The embodiments of the invention in which an exclusive property or privilege is claimed are defined as follows:

1. A bow mounted quiver mountable on an archery bow of the type having a handle section with a hand grip for grasping by the archer and an arrow rest on a first side of the handle section for positioning an arrow preparatory to shooting, said quiver comprising:

base means fixable to the bow handle section, said base means including a portion fixed to the handle portion of the box opposite the first side thereof, a support beam having a first section extending from the portion fixed to the handle around the back of the bow to the opposite side thereof, and a second section extending forward and outward from the first side of the handle section;

an arrow rack comprised as a C-shaped frame having first and second parallel legs connected by an arm, said arm carrying an enlarged boss that is pivotally connected to the base means at the outer end of the second section of the support beam by a releasable nut and bolt assembly so that the arrow rack is pivotable between a first alert position with said legs of the arrow rack frame in a generally vertical orientation when the bow is disposed in a generally vertical orientation and a second storage position with the legs of the frame of the arrow rack disposed in the generally horizontal orientation about a horizontal axis that is perpendicular to the intended longitudinal path of travel of the arrow, said rack having a plurality of arrow holders, each arrow holder includes a first arrow clip and a second arrow clip, said first arrow clips being disposed in a first vertical row on the first leg of the arrow rack when the rack is in the first position, said second arrow clips being disposed in a parallel second vertical row on the second leg of the arrow rack when the rack is in the first position, the first and second arrow clips of each arrow holder being in longitudinal alignment along a horizontal axis parallel to the intended longitudinal path of travel of an arrow when the rack is in the first position;

an arrow guide positioned at the end of one of the rack legs and located beneath the arrow clips and extended toward the arrow rest on the handle of the bow when the rack is in the first position to guide a portion of an arrow shaft released from an arrow holder toward the arrow rest;

pivot means pivotally connecting the arrow rack to the base means for movement of the rack means between said first position and said second position of about a 90 degree arc with said arrows in a generally vertical orientation parallel to the bow in the second position.

2. The bow mounted quiver of claim 1 wherein: each said arrow holding clip includes a stem fixed to the arrow rack and a C-shaped head with a shaft holding opening and a throat for insertion and removal of the shaft from the opening.

3. A bow mounted quiver mountable on an archery bow of the type having a handle section with a hand grip for grasping by the archer and an arrow rest on one side of the handle section for positioning an arrow preperatory to shooting, said quiver comprising:

base means fixable to the bow handle section;

an arrow rack pivotally connected to the base means pivotable between a first alert position and a second storage position about an axis that is perpendicular to the intended longitudinal path of travel of the arrow, said rack having a plurality of arrow holders, each arrow holder including a first arrow clip and a second arrow clip, said first arrow clips being disposed in a first vertical row when the rack is in the first position, said second arrow clips being disposed in a parallel second vertical row when the rack is in the first position, the first and second arrow clips of each arrow holder being in longitudinal alignment along a horizontal axis parallel to the intended longitudinal path of travel of an arrow when the rack is in the first position, each said arrow holding clip including a stem fixed to the arrow rack and a C-shaped head with a shaft holding opening and a throat for insertion and removal from the opening, the stem of each arrow clip having a forwardly facing slit extending the breath of the stem and leaving an intact residual rear portion which functions as a hinge for rotation of the head relative to the lower portion of the stem upon removing of an arrow held by the arrow holder;

pivot means pivotably connecting the arrow rack to the base means for movement of the rack means between said first position and said second position of about a 90 degree arc with said arrows in a generally vertical orientation parallel to the bow in the second position.

4. The bow mounted quiver of claim 3 wherein: said rack is comprised as a C-shaped member which is downwardly orientated when the rack is in the first position, having fore and aft legs and an arm connecting the fore and aft legs, said first row of arrow holding clips being located on the fore leg, said second row of arrow holding clips being located on the aft leg.

5. The bow mounted quiver of claim 4 wherein: said first row of arrow holding clips are integrally formed with a common base, said base being secured to the fore leg; said second row of second arrow holding clips being integrally formed with a common base, said base being removably assembled to the aft leg of the rack.

6. The bow mounted quiver of claim 5 wherein; said base means includes a bracket assembled to the handle section of the bow on the side of the bow opposite the arrow rest; a support beam assembled to the bracket and having a first section extending arround the back of the bow to the opposite side of bow and a second section extending outwardly and forwardly relative to the bow with an outer end, said outer end being pivotally assembled to the arrow rack.

7. The bow mounted quiver of claim 6 wherein: said arrow rack has a shoulder on the arm connecting the fore and aft legs, said shoulder being in abutting engagement with the outer end of the support beam, a threaded finger knob assembly releasably connecting the shoulder and the support beam for pivotal movement about said horizontal axis, said finger knob assembly adapted to be tightened to hold the arrow rack in said positions.

8. The bow mounted quiver of claim 7 including; an arrow guide assembled to the lower end of the aft leg, said arrow guide extending to a location proximate the arrow rest on the box to guide an arrow shaft released from an arrow holder from the rack to the correct position with respect to the bow.

9. A quiver for mounting on a bow proximate the bow handle and arrow rest and carrying a supply of arrows, comprising:

a C-shaped frame having a first leg carrying a first row of resilient arrow holding clips and a second leg parallel to the first leg and carrying a second parallel row of resilient arrow holding clips spaced a short distance from the first row;

each arrow clip of the first row in alignment with an arrow clip of the second row forming a plurality of arrow shaft holders;

each clip having a head fixed to the frame and having an arrow shaft engaging opening and a throat communicating with the opening for insertion and removal of a portion of an arrow shaft;

mounting means for movably mounting the frame to a bow so that frame is movable between a first alert position with the first and second legs of the frame horizontally disposed when the bow is in horizontal orientation so that the first and second rows of arrow holding clips are vertically disposed in facing relationship to the bow handle on the discharge side of the bow to hold a supply of arrows in horizontal orientation in parallel, vertically aligned relationship preparatory to loading and shooting, and a second storage position with said first and second rows of arrow holding clips generally horizontally disposed to hold a supply of arrows for storage in generally parallel relationship to the bow;

linear guide means connected to an end of one of the legs of the frame and extended to a position proximate the arrow rest on the bow handle when the frame is in the first position, said guide means located beneath the arrow holding clips on the legs whereby an arrow shaft released from the clips can drop by gravity to the guide means for guidance to a position proximate the arrow rest on the bow handle.

10. A quiver for mounting on a bow proximate the bow handle and arrow rest and carrying a supply of arrows, comprising:

a frame carrying a first row of resilient arrow holding clips and a second parallel row of resilient arrow holding clips spaced a short distance from the first row;

each arrow clip of the first row in alignment with an arrow clip of the second row forming a plurality of arrow shaft holders;

each clip having a head fixed to the frame and having an arrow shaft engaging opening and a short communicating with the opening for insertion and removal of a portion of an arrow shaft;

mounting means for movably mounting the frame to a bow so the frame is movable between a first alert position with the first and second rows of arrow holding clips vertically disposed in facing relationship to the bow handle on the discharge side of the bow when the bow is vertically orientated to hold a supply of arrows in horizontal orientation in parallel, vertically aligned relationship preparatory to loading and shooting, and a second storage position with said first and second rows of arrow holding clips generally horizontally disposed to hold a supply of arrows for storage in generally parallel relationship to the bow;

each arrow holding clip having a stem fixed to the frame at one end and head at the other end, a slit in the stem extending the breadth of the stem and forwardly facing when the frame is in the first position to form a hinge to permit rearward rotation of the head of the clip upon withdrawal of an arrow shaft from the clip.

11. The quiver of claim 10 wherein: said mounting means includes a support beam fixed to the bow at a first end of the side of the bow opposite the discharge side, and a second end located on the discharge side of the bow and pivotally connected to the frame.

12. The quiver of claim 11 including: means pivotally connecting the support beam to the frame include internally threaded means on the second end of the support beam, a threaded shank and a knob fixed to the threaded shank passing through an opening in the frame and being threaded into the internally threaded means on the support beam.

13. The quiver of claim 12 wherein: said frame is a C-shaped member having fore and aft legs vertically disposed when the frame is in the first position, said fore leg having said first row of clips and said aft leg having said second row of clips.

14. The quiver of claim 13 including: an arrow shaft guide member having one end fixed to an end of the aft leg of the frame and an opposite end terminating proximate the arrow rest on the bow when the rame is in the first position.

15. The quiver of claim 14 including: an arrow tip guard fastened to the bow positioned to accept the tips of the arrows in protection relationship when the frame is in the second position.

* * * * *

UNITED STATES PATENT AND TRADEMARK OFFICE

CERTIFICATE OF CORRECTION

PATENT NO. : 4,823,764

DATED : April 25, 1989

INVENTOR(S) : Randy L. Knaack

It is certified that error appears in the above-identified patent and that said Letters Patent is hereby corrected as shown below:

| | | |
|---|---|---|
| Col 1, | 24 | "box" should be --bow--. |
| Col 1, | 30 | "with" should be --which-- |
| Col 1, | 30 | "grap" should be --grab-- |
| Col 1, | 67 | "perpsective" should be --perspective-- |
| Col 2, | 21 | "monted" should be --mounted-- |
| Col 2, | 27 | "perparedness" should be --preparedness-- |
| Col 2, | 35 | "th" should be --the-- |
| Col 2, | 36 | "Mounted" should be --Mounting-- |
| Col 2, | 42 | "sction" should be --section-- |
| Col 3, | 16 | "clips" should be --clip-- |
| Col 3, | 37 | "arrows" should be --arrow-- |
| Col 3, | 44 | "59" should be --50-- |
| Col 3, | 46 | "edge" should be --edges-- |
| Col 3, | 53 | "two" should be --to-- |
| Col 4, | 2 | "box" should be --bow-- |
| Col 5, | 17 | "portion" should be --section-- |
| Col 5, | 17 | "box" should be --bow-- |
| Col 5, | 38 | "includes" should be --including-- |
| Col 6, | 68 | "box" should be --bow-- |
| Col 8, | 2 | "short" should be --throat-- |
| Col 8, | 19 | "end and" insert --the-- |
| Col 8, | 27 | "of" should be --on-- |

UNITED STATES PATENT AND TRADEMARK OFFICE

CERTIFICATE OF CORRECTION

PATENT NO. : 4,823,764

DATED : April 25, 1989

INVENTOR(S) : Randy L. Knaack

It is certified that error appears in the above-identified patent and that said Letters Patent is hereby corrected as shown below:

Col. 8, 45 "rame" should be --frame--.

Signed and Sealed this

Twenty-third Day of October, 1990

*Attest:*

HARRY F. MANBECK, JR.

*Attesting Officer*

*Commissioner of Patents and Trademarks*